US011315453B1

(12) United States Patent
Hosaka

(10) Patent No.: US 11,315,453 B1
(45) Date of Patent: Apr. 26, 2022

(54) TILED DISPLAY DEVICE WITH A TEST CIRCUIT

(71) Applicant: InnoLux Corporation, Miao-Li County (TW)

(72) Inventor: Shuhei Hosaka, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 17/092,306

(22) Filed: Nov. 8, 2020

(51) Int. Cl.
*G09G 3/00* (2006.01)

(52) U.S. Cl.
CPC ..... *G09G 3/006* (2013.01); *G09G 2300/026* (2013.01); *G09G 2330/12* (2013.01)

(58) Field of Classification Search
CPC ..... G09G 3/006; G09G 2330/12; G09G 2300/026
See application file for complete search history.

(56) References Cited

U.S. PATENT DOCUMENTS 5,557,209 A * 9/1996 Crook ..... G01R 31/312 324/537
7,078,920 B2 * 7/2006 Okajima ..... H01L 22/34 257/48
9,928,767 B2 3/2018 Zhu
2001/0025957 A1 * 10/2001 Takahashi ..... G01R 1/0483 257/48
2010/0052722 A1 * 3/2010 Takemoto ..... G01R 31/2886 324/754.06
2015/0056727 A1 * 2/2015 Yamashita ..... G01R 31/2601 438/17
2015/0279796 A1 * 10/2015 Tu ..... H01L 21/78 257/737
2016/0286654 A1 * 9/2016 Romig ..... H01L 21/76831
2016/0291084 A1 * 10/2016 Chen ..... H01L 23/5226
2016/0306072 A1 * 10/2016 A Tharumalingam ..... H01L 24/97

FOREIGN PATENT DOCUMENTS

CN 108431935 A 8/2018
CN 111239585 A 6/2020

* cited by examiner

*Primary Examiner* — Giovanni Astacio-Oquendo
(74) *Attorney, Agent, or Firm* — Winston Hsu

(57) ABSTRACT

An electronic device includes a substrate having a top surface, a bottom surface and a side surface between the top surface and the bottom surface, and a test circuit disposed on the substrate. The test circuit extends from the top surface to the bottom surface through the side surface of the substrate and has a current terminal for an ammeter and a voltage terminal for a voltmeter, both of which are disposed on the bottom surface.

4 Claims, 7 Drawing Sheets

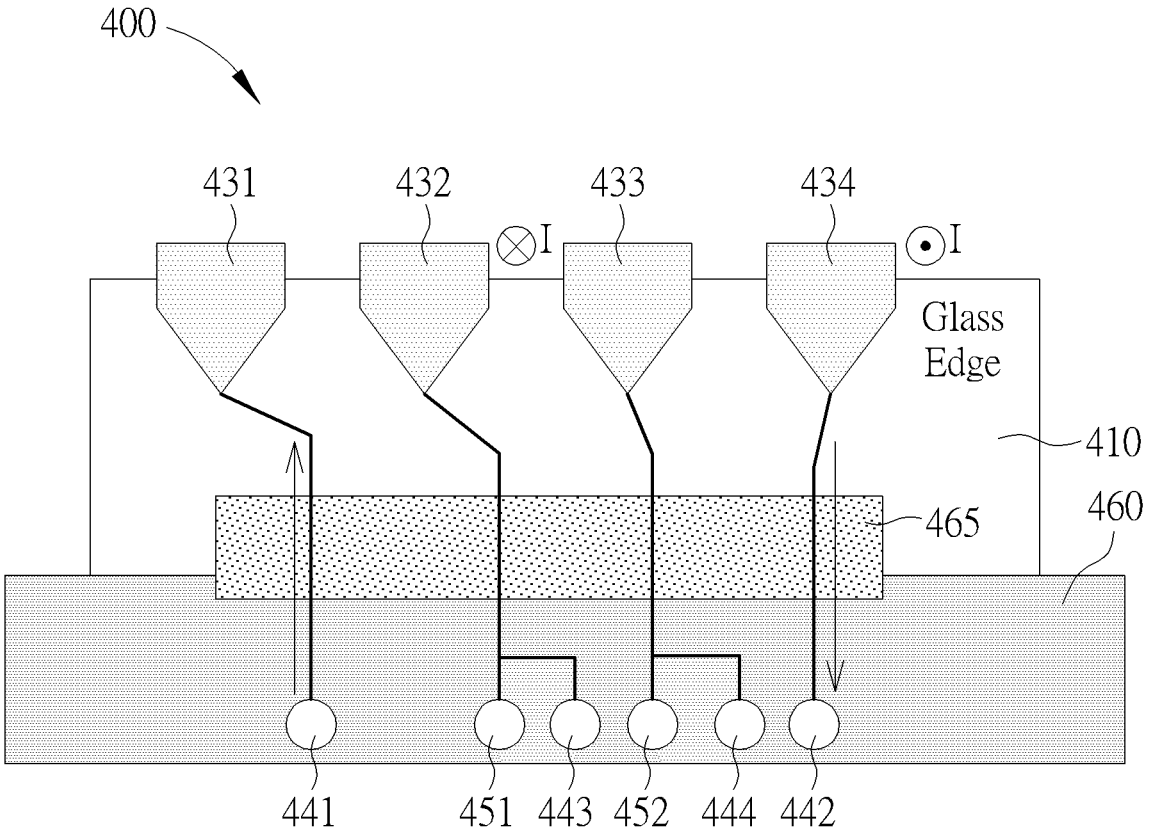
FIG. 4C
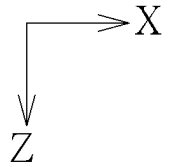

TILED DISPLAY DEVICE WITH A TEST CIRCUIT

BACKGROUND OF THE DISCLOSURE

1. Field of the Disclosure

The present disclosure is related to a display device, and more particularly, to a tiled display device with an embedded test circuit.

2. Description of the Prior Art

With the increase in popularity of visual information transmitting devices, electronic display devices have been actively developed and researched. A self-emissive display device, one of the electronic display devices, is in great demand because it is slim, lightweight and efficient in power-consumption. Also, with the improvement in living standards, a display device with a large size and high image quality has lately attracted considerable attention.

There are limitations to how large the screen can be because of the characteristics of the display device. Recently, a tiled display device in which a plurality of display devices are tiled together with their side surfaces contacting each other to form a large size display device is being put to practical use.

However, tiled display panels do not have border regions and outer lead bonders (OLB). There are not any pads for FPCs (flexible printed circuit), COFs (chip on film), or ICs (integrated circuit) on a glass front surface due to not enough space in the active area. Therefore, there needs a solution to save space in the active area for display panels with a test circuit disposed on the substrate for monitoring the resistance of the display panel.

SUMMARY OF THE DISCLOSURE

The embodiment provides an electronic device, including a substrate having a top surface, a bottom surface and a side surface between the top surface and the bottom surface, and a test circuit disposed on the substrate. The test circuit extends from the top surface to the bottom surface through the side surface of the substrate and has a current terminal for an ammeter and a voltage terminal for a voltmeter, both of which are disposed on the bottom surface.

These and other objectives of the present disclosure will no doubt become obvious to those of ordinary skill in the art after reading the following detailed description of the embodiment that is illustrated in the various figures and drawings.

BRIEF DESCRIPTION OF THE DRAWINGS

FIGS. 4A, 4B and 4C are diagrams of a display panel of another embodiment of the present disclosure.

DETAILED DESCRIPTION

Figure 1A:
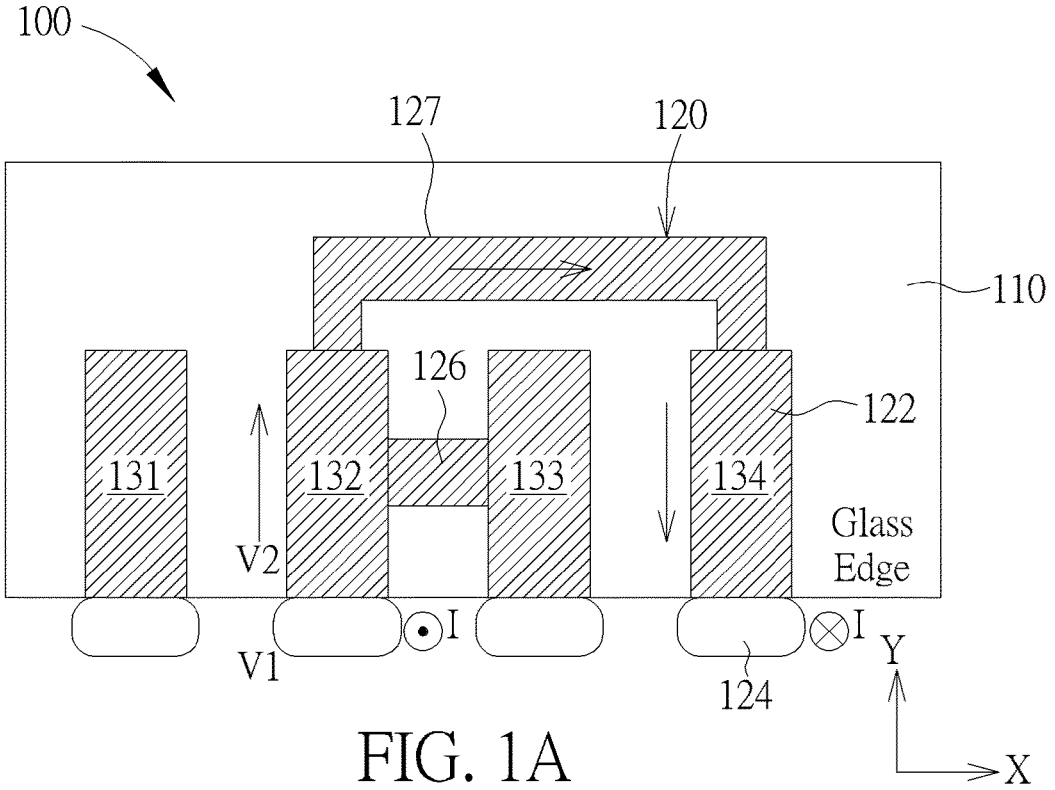
FIGS. 1A and 1B are diagrams of a display panel of an embodiment of the present disclosure.

The present disclosure may be understood by reference to the following detailed description, taken in conjunction with the drawings as described below, and for purposes of illustrative clarity and being easily understood by the readers, various drawings of this disclosure may be simplified, and the elements in various drawings may not be drawn to scale. In addition, the number and dimension of each element shown in drawings are just illustrative and are not intended to limit the scope of the present disclosure.

Certain terms are used throughout the description and following claims to refer to particular elements. As one skilled in the art will understand, electronic equipment manufacturers may refer to an element by different names. This document does not intend to distinguish between elements that differ in name but not function. In the following description and in the claims, the terms "comprise", "include" and "have" are used in an open-ended fashion, and thus should be interpreted to mean "include, but not limited to . . . ".

The direction terms used in the following embodiment such as up, down, left, right, in front of or behind are just the directions referring to the attached figures. Thus, the direction terms used in the present disclosure are for illustration, and are not intended to limit the scope of the present disclosure. It should be noted that the elements which are specifically described or labeled may exist in various forms for those skilled in the art. Besides, when a layer is referred to as being "on" another layer or substrate, it may be directly on the other layer or substrate, or may be on the other layer or substrate, or intervening layers may be included between other layers or substrates.

Besides, relative terms such as "lower" or "bottom", and "higher" or "top" may be used in embodiments to describe the relative relation of an element to another element labeled in figures. It should be understood that if the labeled device is flipped upside down, the element in the "lower" side may be the element in the "higher" side.

The ordinal numbers such as "first", "second", etc. are used in the specification and claims to modify the elements in the claims. It does not mean that the required element has any previous ordinal number, and it does not represent the order of a required element and another required element or the order in the manufacturing method. The ordinal number is just used to distinguish the required element with a certain name and another required element with the same certain name.

It should be noted that the technical features in different embodiments described in the following may be replaced, recombined, or mixed with one another to constitute another embodiment without departing from the spirit of the present disclosure.

In the present disclosure, the electronic device may include a display panel, an antenna device, a sensing device, a tiled device, or a transparent display device but is not limited thereto. The electronic device may include a rollable, stretchable, bendable, or flexible electronic device.

The display panel may include, for example, liquid crystal materials, light-emitting diodes (LED), quantum dot (QD) materials, fluorescence materials, phosphor materials, or other suitable materials, and the above materials may be arbitrarily arranged and combined. The light-emitting diodes may include, for example, organic light-emitting diode (OLED), mini LED, micro LED or quantum dot LED (e.g., QLED or QDLED), but is not limited thereto.

Figure 1B:
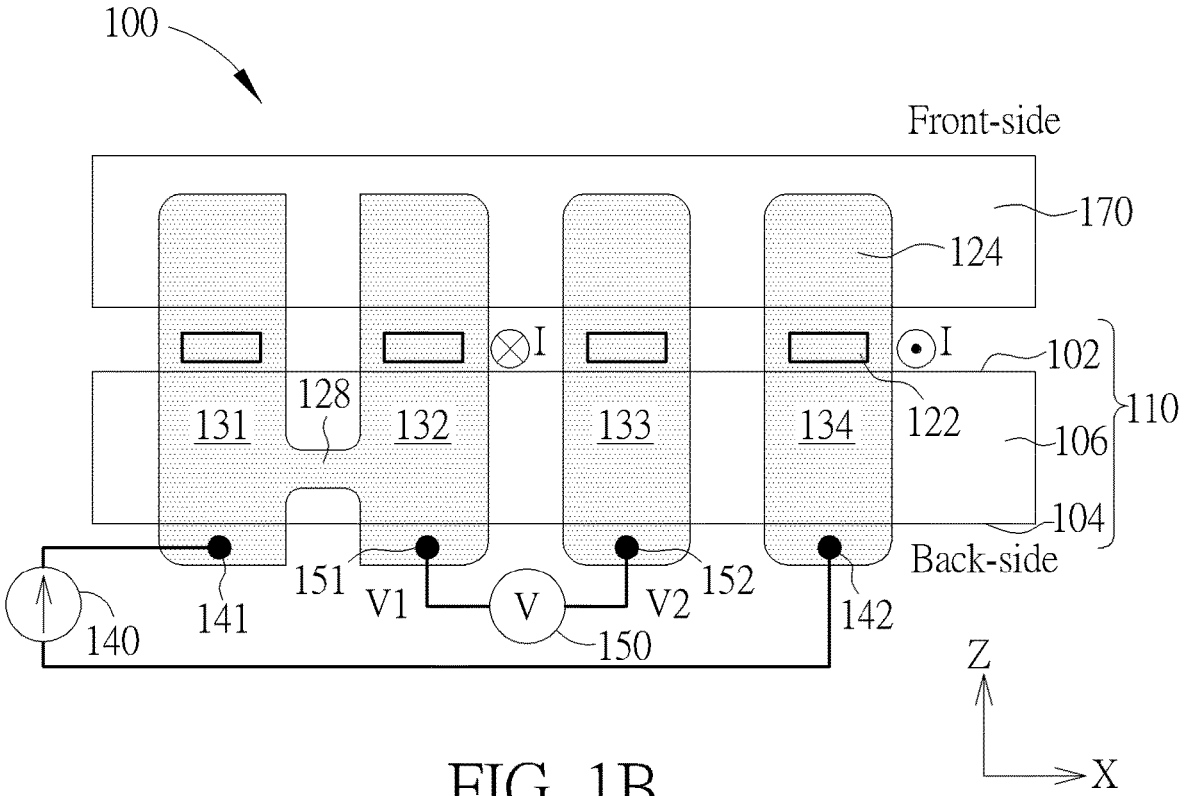

FIGS. 1A and 1B are diagrams of a display panel 100 of an embodiment of the present disclosure. FIG. 1A is the top view of the backplane of the display panel 100. FIG. 1B is the side view of the display panel 100. The display panel 100 includes a substrate 110 (or backplane) having a top surface 102, a bottom surface 104 and a side surface 106 between the top surface 102 and the bottom surface 104. A test circuit 120 is disposed on the substrate 110. The test circuit 120 includes a first wiring 122 on the top surface 102 and a second wiring 124 on the side surface 106. The first wiring 122 and the second wiring 124 are electrically coupled to each other at the boundary of the top surface 102 and the side surface 106.

The first wiring 122 can be formed by metals such as but not limited to copper (Cu), molybdenum (Mo), titanium (Ti) and aluminum (Al). The second wiring 124 can be formed by metal such as, but not limited to, sliver (Ag) and copper (Cu). The first wiring 122 and the second wiring 124 are coupled together to form four pads: a first pad 131, a second pad 132, a third pad 133 and a fourth pad 134. On the top surface 102, the second pad 132 is coupled to the third pad 133 through a first bridge 126 and the second pad 132 is coupled to the fourth pad 134 through a second bridge 127. On the side surface, the first pad 131 is coupled to the second pad 132 through a third bridge 128. The second wiring 124 can extend to another substrate 170 which is opposite to the substrate 110. The substrate 170 can be a transparent cover or an optical substrate which comprises color filter, wavelength conversion layer, or a combination thereof. In more detail, the wavelength conversion layer includes a plurality of quantum dot particles, fluorescence or phosphor material. In another embodiment of the disclosure, the substrate 170 can be omitted.

The connection of the first wiring 122 and the second wiring 124 is measured through the current terminals 141 and 142 and the voltage terminals 151 and 152 with respect to its contact resistance R. The current terminals and the voltage terminals are formed on a printed circuit board assembly which is bonded onto the bottom surface 104 of the substrate 110. In another embodiment of the disclosure, the current terminals 141 and 142 and the voltage terminals 151 and 152 are formed on the bottom surface 104 of the substrate 110. A voltmeter 150 is used to measure the voltage, and an ammeter 140 is used to measure the current. The resistance R can be obtained by the equation:

$$R = \frac{V1 - V2}{I}$$

V1−V2 is the voltage difference between the voltage terminals 151 and 152, and is measured by the voltmeter 150. I is the current flowing from the current terminal 141 to the current terminal 142 and is measured by the ammeter 140.

Figure 2A:
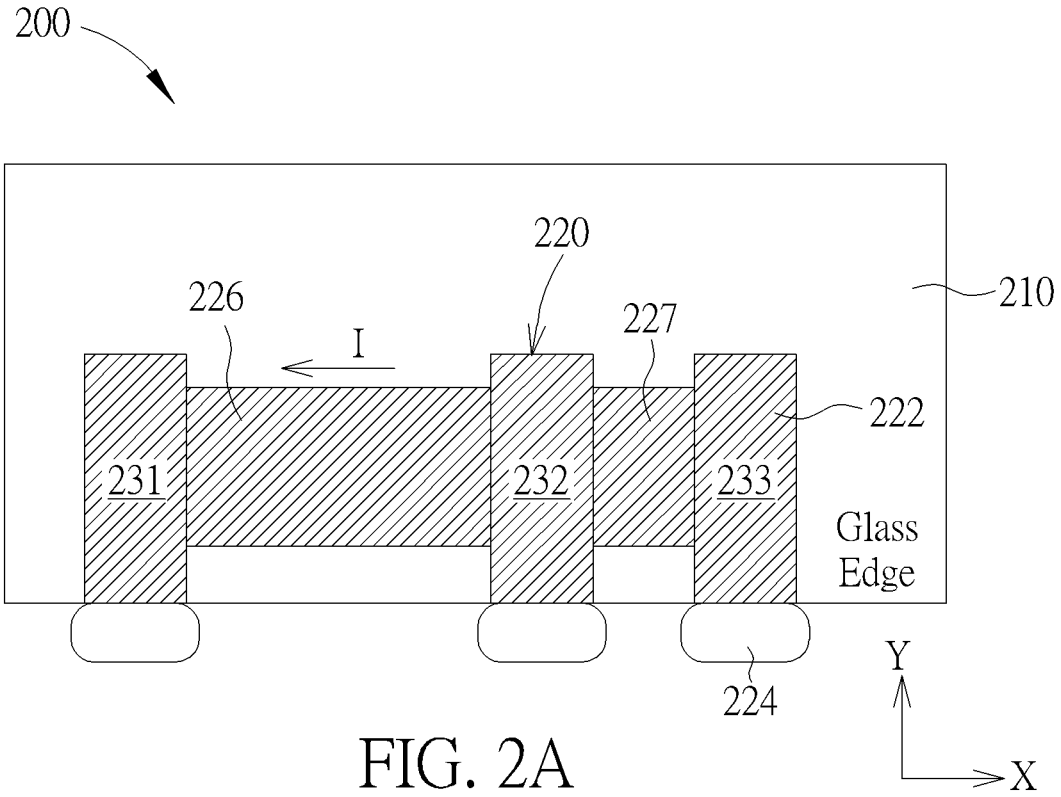
FIGS. 2A and 2B are diagrams of a display panel of another embodiment of the present disclosure.
Figure 2B:
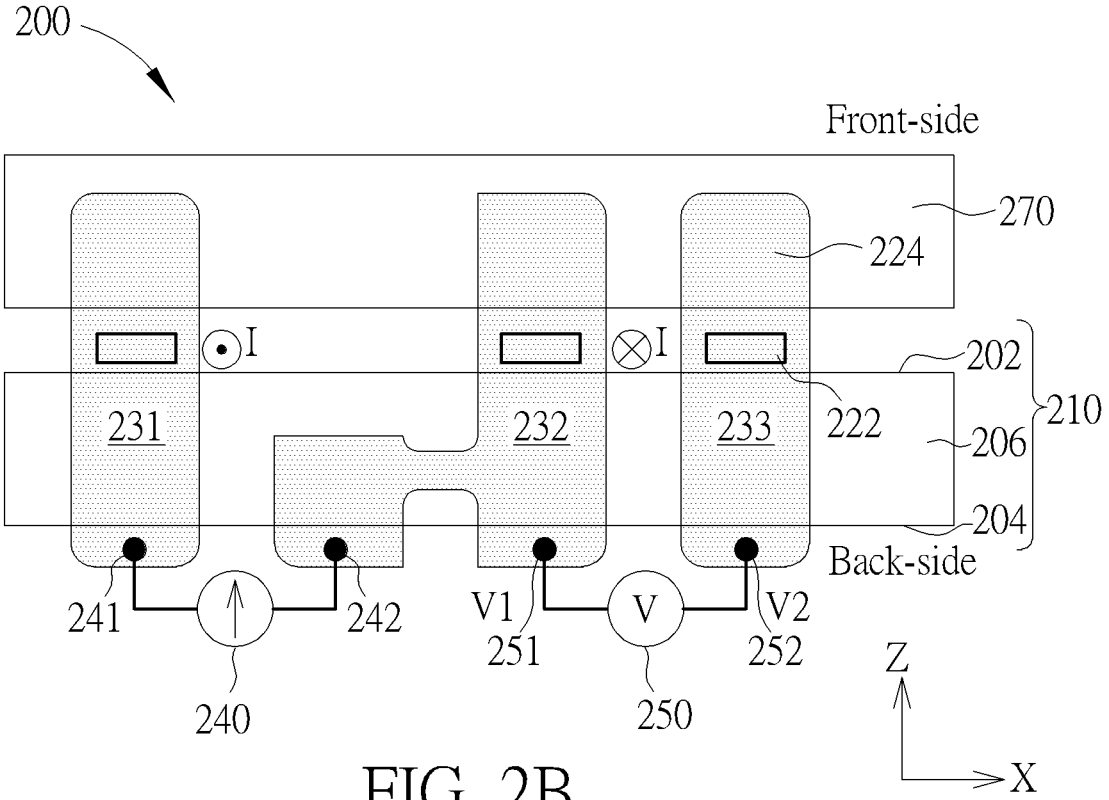

FIGS. 2A and 2B are diagrams of a display panel 200 of another embodiment of the present disclosure. FIG. 2A is the top view of the backplane of the display panel 200. FIG. 2B is the side view of the display panel 200. The display panel 200 includes a substrate 210 (or backplane) having a top surface 202, a bottom surface 204 and a side surface 206 between the top surface 202 and the bottom surface 204. A test circuit 220 is disposed on the substrate 210. The test circuit 220 includes a first wiring 222 on the top surface 202 and a second wiring 224 on the side surface 206. The first wiring 222 and the second wiring 224 are electrically coupled to each other at the boundary of the top surface 202 and the side surface 206.

The first wiring 222 can be formed by metals such as, but not limited to, copper (Cu), molybdenum (Mo), titanium (Ti) and aluminum (Al). The second wiring 224 can be formed by metal such as, but not limited to, sliver (Ag) and copper (Cu). The first wiring 222 and the second wiring 224 are coupled together to form three pads: a first pad 231, a second pad 232, and a third pad 233. On the top surface 202, the first pad 231 is coupled to the second pad 232 through a first bridge 226 and the second pad 232 is coupled to the third pad 233 through a second bridge 227. The second wiring 224 can extend to another substrate 270 which is opposite to the substrate 210. The substrate 270 can be a transparent cover or an optical substrate which comprises color filter, wavelength conversion layer, or a combination thereof. In more detail, the wavelength conversion layer includes a plurality of quantum dot particles, fluorescence or phosphor material. In another embodiment of the disclosure, the substrate 270 can be omitted.

The connection of the first wiring 222 and the second wiring 224 is measured through the current terminals 241 and 242 and the voltage terminals 251 and 252 with respect to its resistance. The current terminals and the voltage terminals are formed on a printed circuit board assembly which is bonded onto the bottom surface 204 of the substrate 210. In another embodiment of the disclosure, the current terminals 241 and 242 and the voltage terminals 251 and 252 are formed on the bottom surface 204 of the substrate 210. A voltmeter 250 is used to measure the voltage, and an ammeter 240 is used to measure the current. The resistance of the wiring structure can be obtained by the same way as previously described.

Figure 3A:
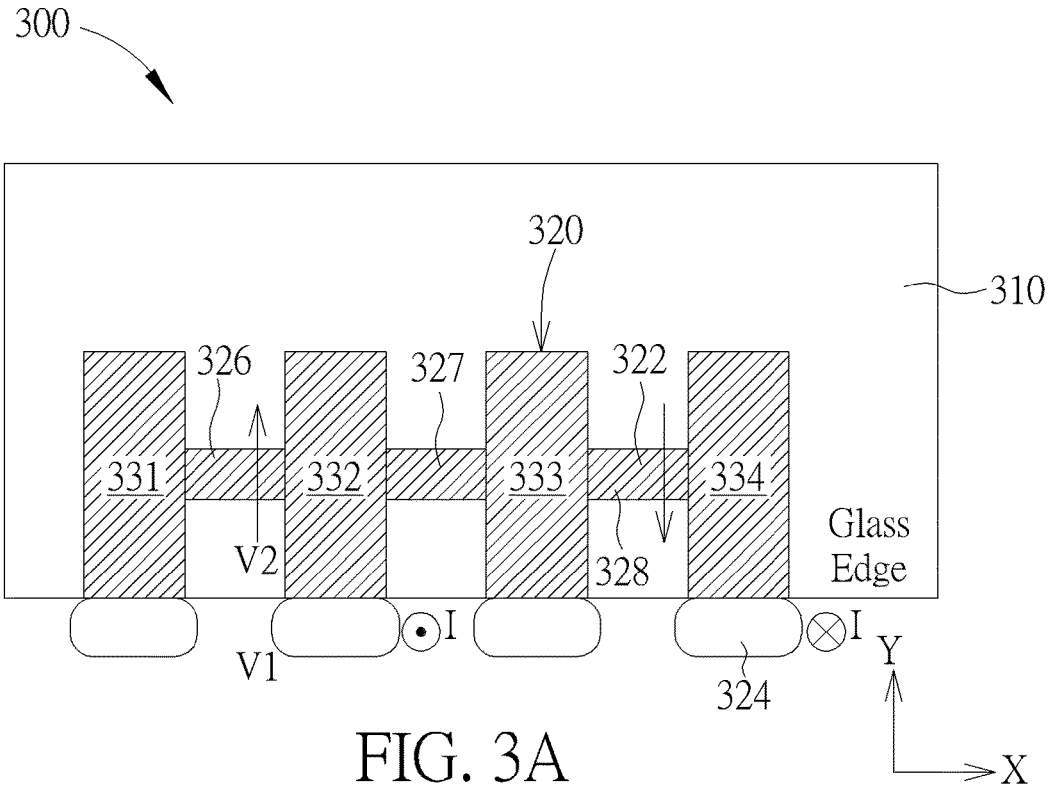
FIGS. 3A and 3B are diagrams of a display panel of another embodiment of the present disclosure.
Figure 3B:
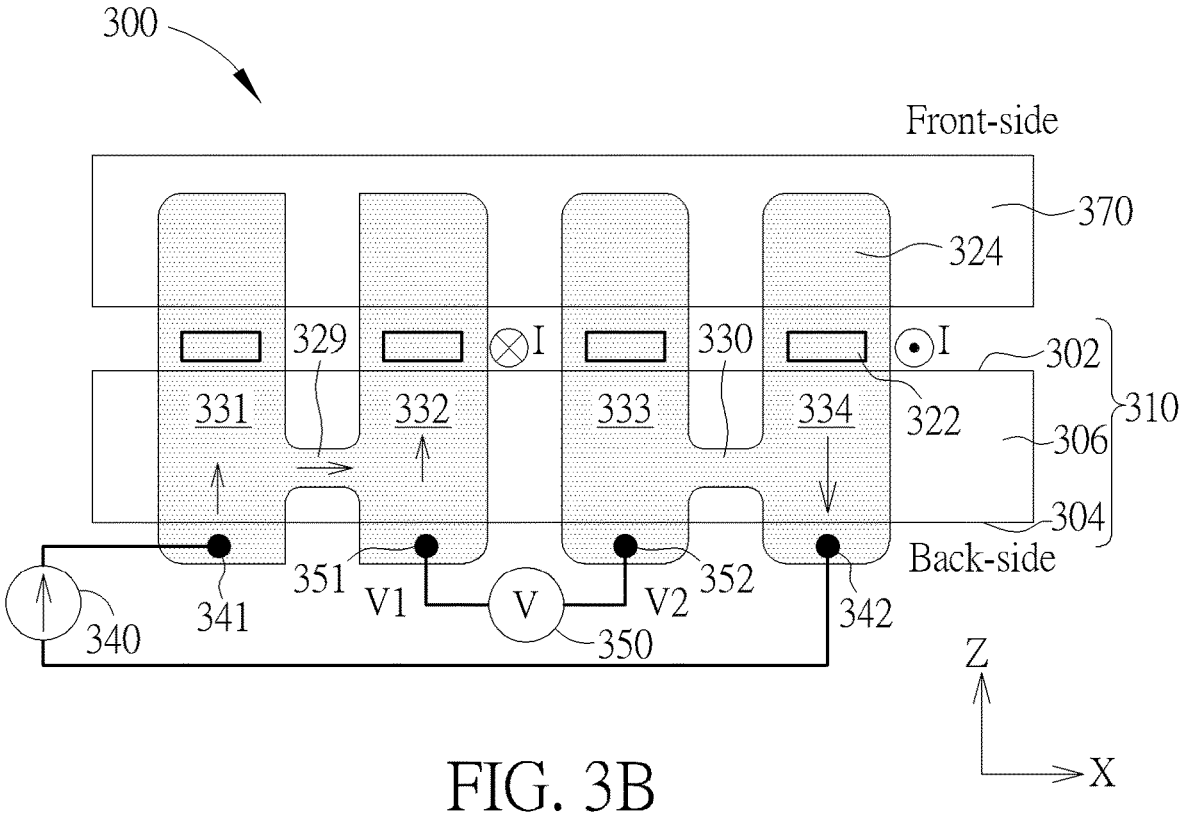

FIGS. 3A and 3B are diagrams of a display panel 300 of another embodiment of the present disclosure. FIG. 3A is the top view of the backplane of the display panel 300. FIG. 3B is the side view of the display panel 300. The display panel 300 includes a substrate 310 (or backplane) having a top surface 302, a bottom surface 304 and a side surface 306 between the top surface 302 and the bottom surface 304. A test circuit 320 is disposed on the substrate 310. The test circuit 320 includes a first wiring 322 on the top surface 302 and a second wiring 324 on the side surface 306. The first wiring 322 and the second wiring 324 are electrically coupled to each other at the boundary of the top surface 302 and the side surface 306.

The first wiring 322 can be formed by metals such as, but not limited to, copper (Cu), molybdenum (Mo), titanium (Ti) and aluminum (Al). The second wiring 324 can be formed by metal such as, but not limited to, sliver (Ag) and copper (Cu). The first wiring 322 and the second wiring 324 are coupled together to form four pads: a first pad 331, a second pad 332, a third pad 333 and a fourth pad 334. On the top surface 302, the first pad 331 is coupled to the second pad 332 through a first bridge 326, the second pad 332 is coupled to the third pad 333 through a second bridge 327, and the third pad 333 is coupled to the fourth pad 334 through a third bridge 328. On the side surface 306, the first pad 331 is coupled to the second pad 332 through a fourth bridge 329, and the third pad 333 is coupled to the fourth pad 334 through a fifth bridge 330. The second wiring 324 can extend to anther substrate 370 which is opposite to the substrate 310. The substrate 370 can be a transparent cover or an optical substrate which comprises color filter, wavelength conversion layer, or a combination thereof. In more detail, the wavelength conversion layer includes a plurality of quantum dot particles, fluorescence or phosphor material. In another embodiment of the disclosure, the substrate 370 can be omitted.

The connection of the first wiring 322 and the second wiring 324 is measured through the current terminals 341 and 342 and the voltage terminals 351 and 352 with respect to its resistance. The current terminals and the voltage terminals are formed on a printed circuit board assembly which is bonded onto the bottom surface 304 of the substrate 310. In another embodiment of the disclosure, the current terminals 341 and 342 and the voltage terminals 351 and 352 are formed on the bottom surface 304 of the substrate 310. A voltmeter 350 is used to measure the voltage, and an ammeter 340 is used to measure the current. The resistance of the wiring structure can be obtained by the same way as previously described.

Figure 4A:
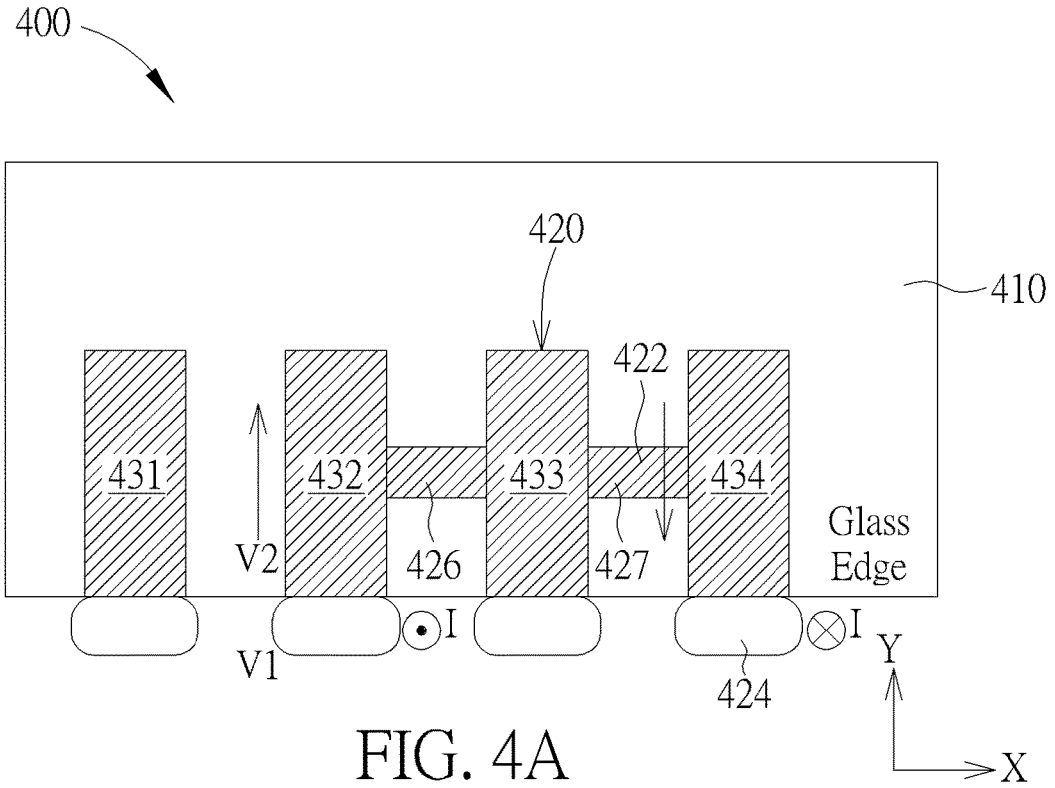
Figure 4B:
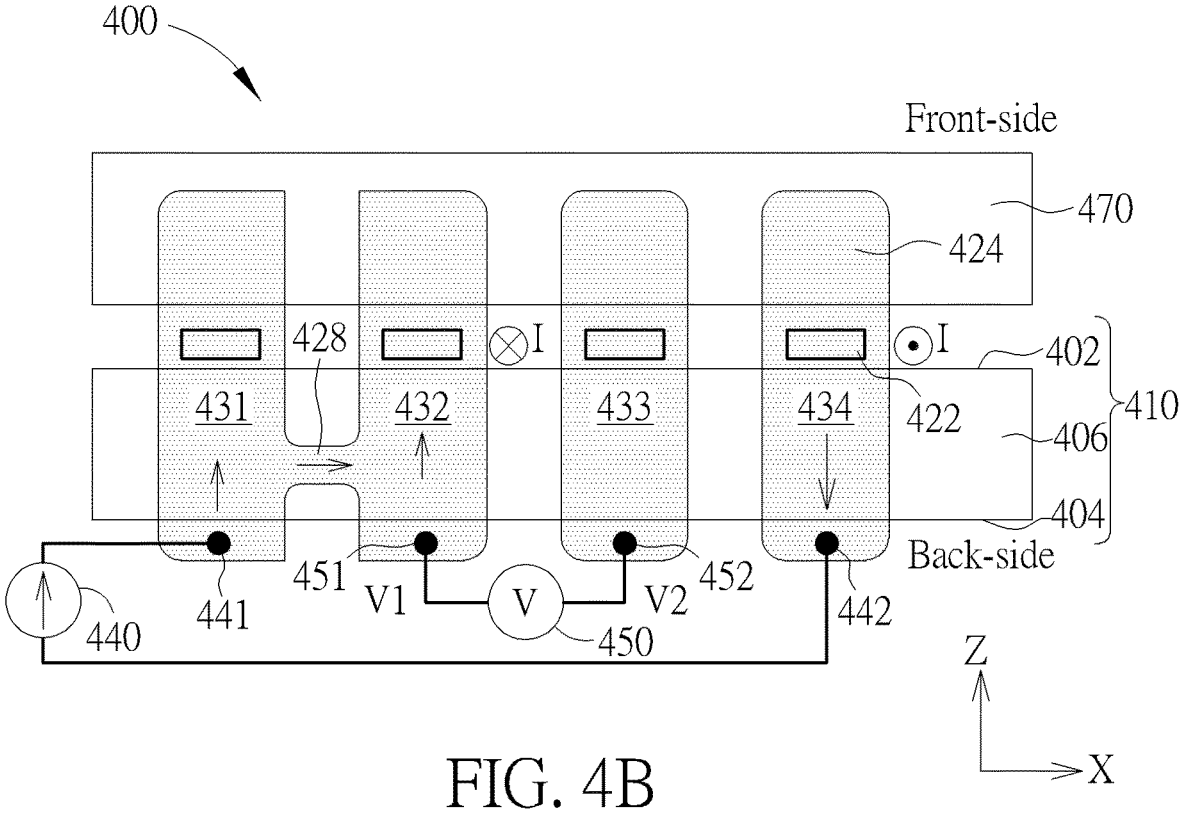

FIGS. 4A, 4B and 4C are diagrams of a display panel 400 of another embodiment of the present disclosure. FIG. 4A is the top view of the backplane of the display panel 400. FIG. 4B is the side view of the display panel 400. The display panel 400 includes a substrate 410 (or backplane) having a top surface 402, a bottom surface 404 and a side surface 406 between the top surface 402 and the bottom surface 404. A test circuit 420 is disposed on the substrate 410. The test circuit 420 includes a first wiring 422 on the top surface 402 and a second wiring 424 on the side surface 406. The first wiring 422 and the second wiring 424 are electrically coupled to each other at the boundary of the top surface 402 and the side surface 406.

The first wiring 422 can be formed by metals such as, but not limited to, copper (Cu), molybdenum (Mo), titanium (Ti) and aluminum (Al). The second wiring 424 can be formed by metal such as, but not limited to, sliver (Ag) and copper (Cu). The first wiring 422 and the second wiring 424 are coupled together to form four pads: a first pad 431, a second pad 432, a third pad 433 and a fourth pad 434. On the top surface 402, the second pad 432 is coupled to the third pad 433 through a first bridge 426, and the third pad 433 is coupled to the fourth pad 434 through a second bridge 427. On the side surface 406, the first pad 431 is coupled to the second pad 432 through a third bridge 428. The second wiring 424 can extend to another substrate 470 which is opposite of the substrate 410. The substrate 470 can be a transparent cover or an optical substrate which comprises color filter, wavelength conversion layer, or a combination thereof. In more detail, the wavelength conversion layer includes a plurality of quantum dot particles, fluorescence or phosphor material. In another embodiment of the disclosure, the substrate 470 can be omitted.

The connection of the first wiring 422 and the second wiring 424 is measured through the current terminals 441 and 442 and the voltage terminals 451 and 452 with respect to its resistance. The current terminals and the voltage terminals are formed on a printed circuit board assembly which is bonded onto the bottom surface 404 of the substrate 410. In another embodiment of the disclosure, the current terminals 441 and 442 and the voltage terminals 451 and 452 are formed on the bottom surface 404 of the substrate 410. A voltmeter 450 is used to measure the voltage, and an ammeter 440 is used to measure the current. The resistance of the wiring structure can be obtained by the same way as previously described.

FIG. 4C is a diagram of the bottom view of the backplane of the display panel 400. A printed circuit board assembly (PCBA) 460 is bonded onto the substrate 410 via a flexible printed circuit 465. The current terminals 441, 442, 443 and 444 and the voltage terminals 451 and 452 are formed on the PCBA 460. The wiring resistance of the wiring structure between the terminals and the pads can be measured through the current terminals 443 and 444 and the voltage terminals 451 and 452. The detail explanation is described below.

Figure 5:
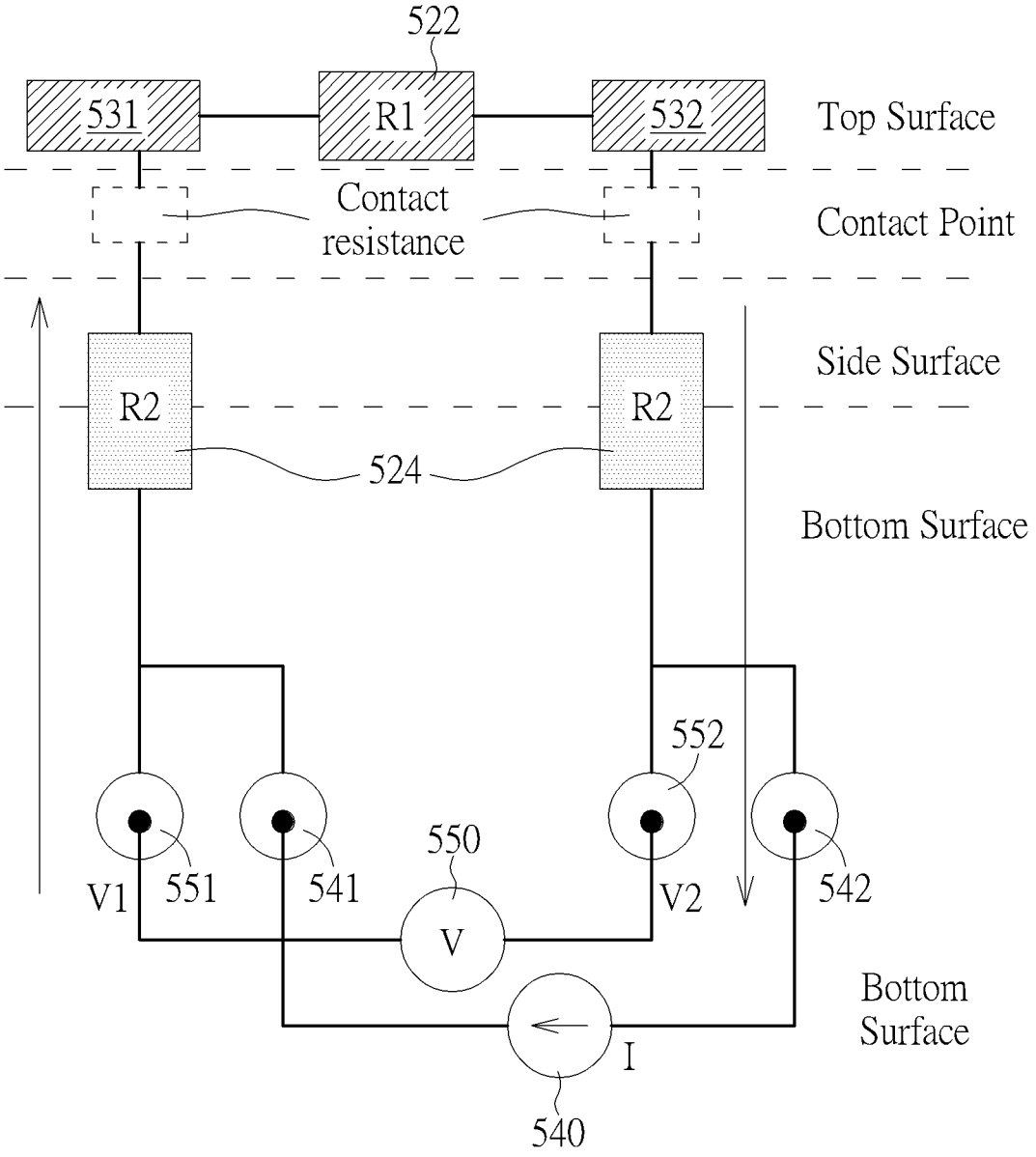
FIG. 5 is a diagram illustrating the principle of measuring the wiring resistance of a display panel of an embodiment.

FIG. 5 is a diagram illustrating the principle of measuring the wiring resistance of a display panel of an embodiment. A first pad 531 is coupled to the second pad 532 via a first wiring 522 on the top surface. The first wiring 522 has resistance R1. The second wiring 524 extends from the side surface to the bottom surface. The second wiring 524 has resistance R2. The second wiring 524 is coupled to the first wiring 522 through the first pad 531 and the second pad 532. The contact point between the first pad 531 and the second wiring 524 and the contact point between the second pad 532 and the second wiring 524 is at the boundary of the top surface and the side surface. A voltmeter 550 is used to measure the voltage, and an ammeter 540 is used to measure the current. Assuming the contact resistance between the first wiring 522 and the second wiring 524 is much less than the resistance R2 of the second wiring 524, and the resistance R1 of the first wiring is also much less than the resistance R2 of the second wiring 524, the resistance R of the wiring structure can be obtained by the equation:

$$R = R2 = \frac{V1 - V2}{I} \times \frac{1}{2}$$

$$R1 \ll R2$$

V1−V2 is the voltage difference between the voltage terminals 551 and 552 and is measured by the voltmeter 550. I is the current flowing from the current terminal 542 to the current terminal 541 and is measured by the ammeter 540.

Figure 6:
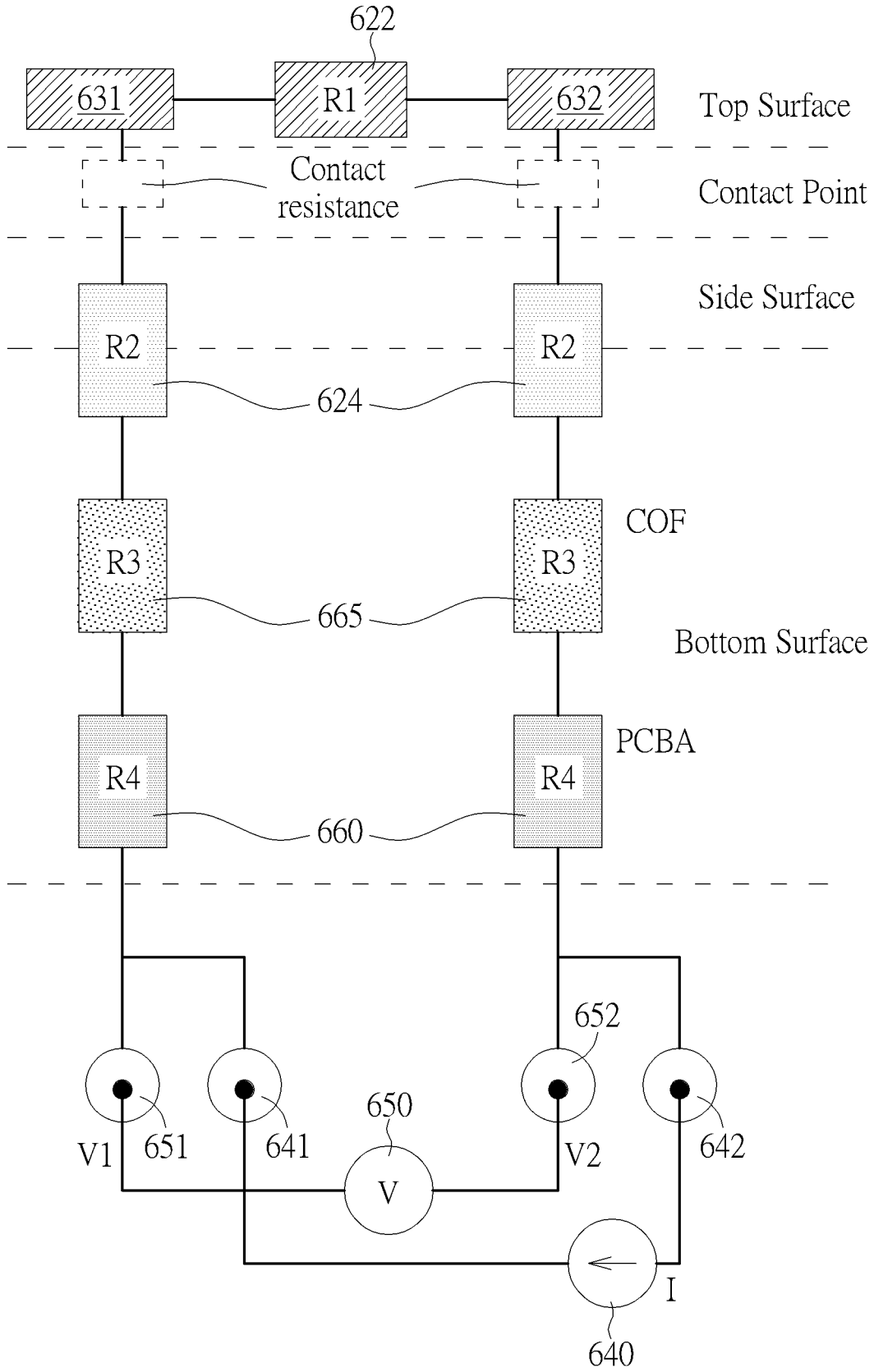
FIG. 6 is a diagram illustrating the principle of measuring the wiring resistance of a display panel of another embodiment.

FIG. 6 is a diagram illustrating the principle of measuring the wiring resistance of a display panel of another embodiment. The first pad 631 is coupled to the second pad 632 via the first wiring 622 on the top surface. The first wiring 622 has resistance R1. The second wiring 624 extends from the side surface to the bottom surface. The second wiring 624 has resistance R2. The second wiring 624 is coupled to the first wiring 622 through the first pad 631 and the second pad 632. The contact point between the first pad 631 and the second wiring 624 and the contact point between the second pad 632 and the second wiring 624 is at the boundary of the top surface and the side surface. The third wiring 665 is formed on the flexible printed circuit (FPC) and has resistance R3. The fourth wiring 660 is formed on the printed circuit board assembly and has resistance R4. A voltmeter 650 is used to measure the voltage, and an ammeter 640 is used to measure the current. Assuming the contact resistance between the first wiring 622 and the second wiring 624 is much less than the resistances R2, R3 or R4 of the wiring structure, and the resistance R1 of the first wiring 622 is also much less than the resistances R2, R3 or R4 of the wiring structure, the resistance R of the wiring structure can be obtained by the equation:

$$R = R2 + R3 + R4 = \frac{V1 - V2}{I} \times \frac{1}{2}$$

$$R1 \ll R2, R3, R4$$

V1−V2 is the voltage difference between the voltage terminals 651 and 652 and is measured by the voltmeter 650. I is the current flowing from the current terminal 642 to the current terminal 641 and is measured by the ammeter 640.

In summary, the display panels of the embodiments provide a novel design that can save space in the active area while providing a test circuit disposed on the substrate to monitor the contact resistance between the first and second wirings on the top surface and the side surface and the wiring resistance of the wirings on the bottom surface of the display panel.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An electronic device, comprising:

a substrate having a top surface, a bottom surface and a side surface between the top surface and the bottom surface;

an another substrate opposite to the substrate; and a test circuit disposed on the substrate, comprising a wiring disposed on the side surface of the substrate, wherein the wiring extends to the another substrate;

wherein the test circuit extends from the top surface to the bottom surface through the side surface of the substrate and has a current terminal for an ammeter and a voltage terminal for a voltmeter, both of which are disposed on the bottom surface.

2. The electronic device according to claim 1, wherein the test circuit comprises a first wiring on the top surface and a second wiring on the side surface which are electrically connected with each other at a boundary of the top surface and the side surface.

3. The electronic device according to claim 2, wherein the connection of the first wiring and the second wiring is measured through the current terminal and the voltage terminal with respect to its resistance.

4. The electronic device according to claim 1, wherein the current terminal and the voltage terminal are formed on a printed circuit board assembly which is bonded onto the bottom surface of the substrate.

* * * * *